United States Patent [19]

Bolea Camprubi

[11] 3,981,331

[45] Sept. 21, 1976

[54] CROSSING WARP MECHANISM

[75] Inventor: Anselmo Bolea Camprubi, Barcelona, Spain

[73] Assignee: Incotex, S.A., Sabadell (Barcelona), Spain

[22] Filed: July 23, 1975

[21] Appl. No.: 598,352

[30] Foreign Application Priority Data

July 31, 1974 Spain ..... 205051

[52] U.S. Cl. ..... 139/54

[51] Int. Cl.[2] ..... D03D 47/40

[58] Field of Search ..... 139/48, 54, 122 S, 291 C

[56] References Cited

UNITED STATES PATENTS 3,794,083 2/1974 Czelusniak ..... 139/54

FOREIGN PATENTS OR APPLICATIONS 23,908 3/1901 Switzerland ..... 139/54

*Primary Examiner*—Henry S. Jaudon

*Attorney, Agent, or Firm*—Toren, McGeady and Stanger

[57] ABSTRACT

A crossing warp mechanism is actuated by a cam shaft of a loom through a pulley and belt arrangement. A rod carrying a plurality of needles for forming the center selvedge in a fabric is subject both to reciprocating movement by the pivoting of a grooved plate which is pivoted in response to a rotating shaft, and to oscillating movement by engagement of a tooth on a sleeve surrounding the rod with a helically-grooved member rotated by the same shaft via a pinion gear.

6 Claims, 3 Drawing Figures

CROSSING WARP MECHANISM

SUMMARY OF THE INVENTION

The present invention is directed to an improved crossing warp mechanism of the type used in looms for the formation of the center selvedge in a fabric.

The fundamental characteristic of the present invention is in the way the crossing warp mechanism moves and the structure of the mechanism to afford such movement. Specifically, a rod carrying needles by which the center selvedge is formed in a fabric is subject to both a reciprocating and oscillating movement so that threads are inserted between the weft. To bring about the combined motion of the rod and the needles attached to the rod, a sleeve is provided in engagement with the rod. The sleeve, which encircles the rod, has a tooth which projects from its circumference, and the tooth engages a helical groove formed in a rotating rim. The rotation of the rim via a pinion gear affixed to a rotating shaft, effects the oscillating movement of the rod via the helical groove and the tooth.

The reciprocating movement of the rod and needles is achieved by a grooved lever arranged to be pivoted about the end and connected at its other end to the rod. The rotating shaft effecting the oscillating movement of the needles also affords the reciprocating movement by the attachment of a plate at the end of the rotating shaft, which plate has a lug engaging in the groove of the grooved lever.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE INVENTION

DETAILED DESCRIPTION OF THE INVENTION

Figure 1:
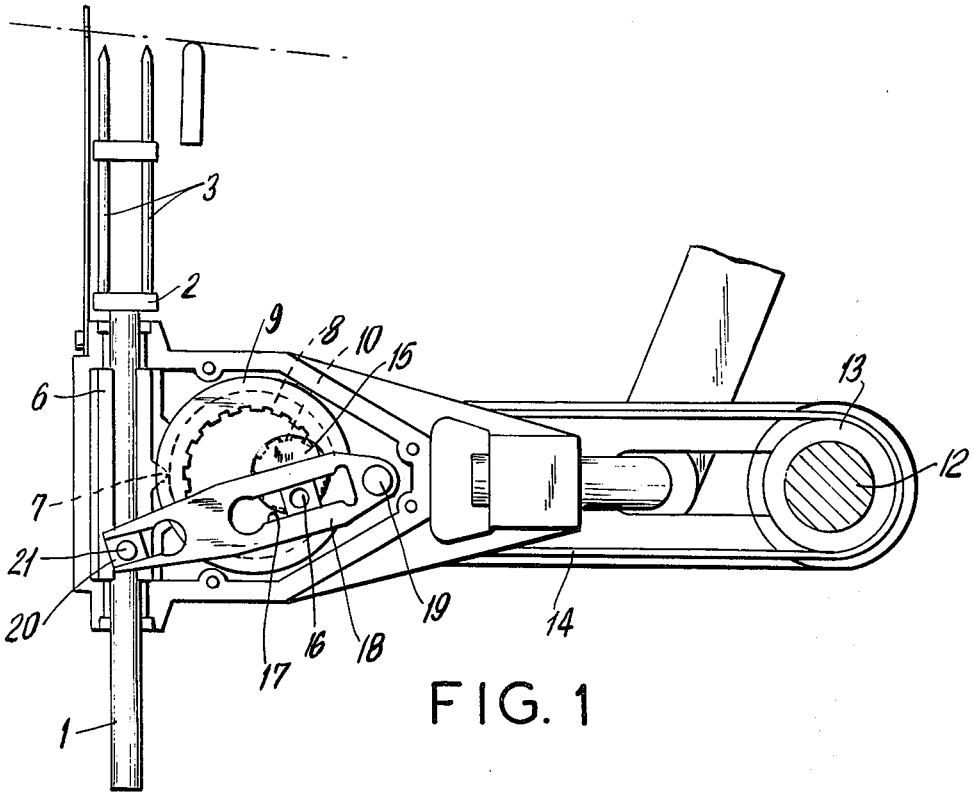
FIG. 1 is a side elevational view of a crossing warp mechanism embodying the present invention.

As shown in FIG. 1, the improved crossing warp mechanism of the present invention includes an axially elongated rod 1 which supports needle holding plate 2 carrying a plurality of needles 3 projecting outwardly from the plate and extending in the axial direction of the shaft. The needles 3 are used to form the center selvedge of a fabric to be produced on a loom by alternately inserting threads between the weft. Depending on whether single or double braiding is desired, either two or four needles 3 are used.

Figure 3:
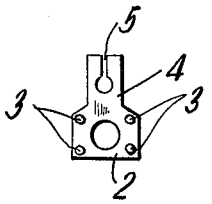
FIG. 3 is a detail of a part of the crossing warp mechanism shown in FIG. 1.

As shown in FIG. 3, the needle holding plate 2 is formed with a projection 4 extending transversely of the needles. The projection has a cutout 5 for the weft gripper.

Figure 2:
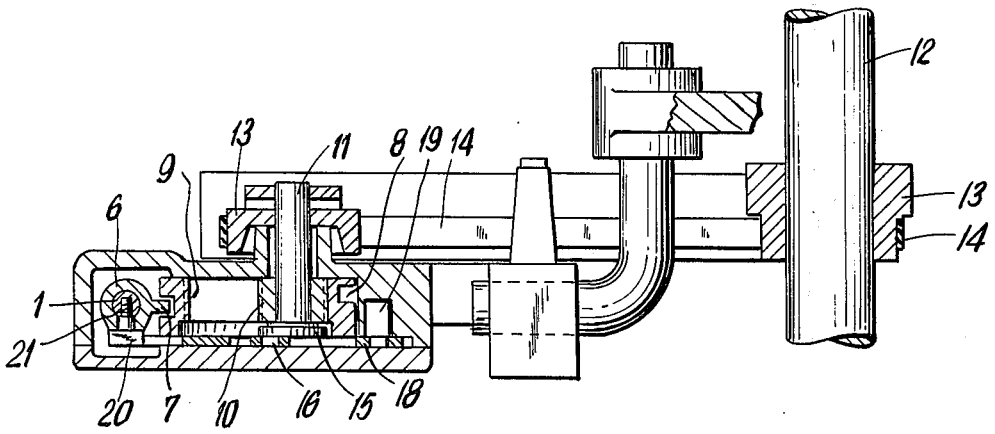
FIG. 2 is a plan view partly in section of the crossing warp mechanism shown in FIG. 1.

The rod 1 is enclosed along a part of its axial length by a rotatably mounted sleeve 6 and the sleeve is connected to the rod 1 so that the rod can slide relative to the sleeve while the sleeve transmits oscillatory movement to the rod. Projecting from the circumference of the sleeve 6 is a tooth 7. The tooth 7 engages in a helical groove 8 formed in the outer circumference of a rim 9. The rim 9 is rotated via a pinion gear 10, as shown in FIG. 2, which is mounted in the interior of the rim 9 and engages teeth formed in the inner circumference of the rim.

The pinion gear 10 is mounted on a shaft 11 which is rotatably driven by an auxiliary shaft 12 of a loom, over pulleys 13 and belt 14. As the shaft 11 rotates, the rim 9 is rotated by the pinion gear 10 in the same direction as both shaft 11 and pinion gear 10. With the tooth 7 of the sleeve 6 engaging in the groove 8, the sleeve 6 and rod 1 experience motion about the axis of the rod as the tooth 7 slides along the helical groove 8.

Mounted at one end of the shaft 11 is a plate 15 with a projecting lug 16 arranged eccentrically on the shaft. An elongated lever 18 is pivoted to the frame of the device at one end 19, and at its other end is affixed to the rod 1 by a square 20 and a screw 21. The lever 18 has a groove 17 extending along a part of its length between its ends and the groove receives lug 16 of the plate 15. Upon rotation of the shaft 11, the elongated lever 18 which is pivoted at 19 has a slot at one end thereof wherein the square 20 is slidably mounted. As the lever 18 pivots about the end 19, the square 20 will slide relative to the lever 18 within the elongated slot at its left end, as viewed in FIG. 1. However, in addition to this movement, when the sleeve 6 is caused to rotate by engagement of the tooth 7 within the helical groove 8, the sides of the sleeve defining the slot through which the screw 21 extends will become engaged against the screw and cause the screw and the square 20 to rotate together with the sleeve. Thus, the rotation of the sleeve will be imparted to the rod 1 through the screw 21 and the square 20. However, inasumuch as the square 20 is slidably positioned within the slot at the left end of the lever 18, the square 20 will not only be slidable in the longitudinal direction of the lever 18 but will also be movable about the axis of rotation of the rod 1 and it will thereby move slightly in a rotative sense within the slot of the lever 18 and relative to the lever 18. It should be understood that the degree of rotation of the sleeve 6 is relatively slight and despite the fact that the square 20 rotates with the sleeve 6 relative to the lever 18, the square 20 nevertheless remains engaged within the slot of the lever 18 in order to impart reciprocating motion to the rod 1 when the lever 18 pivots about the end 19.

In its essence, the invention can be carried into effect in other forms of realization which differ in detail from that indicated only by way of example.

What is claimed is:

1. A crossing warp mechanism comprising an axially extending rod, a holder plate attached to one end of said rod, a plurality of needles secured to and extending outwardly from said holder plate, a sleeve laterally enclosing an axially extending portion of said rod, said rod being connected to said sleeve so that said rod is axially slidable relative to said sleeve, first means contacting said sleeve for oscillating said sleeve about the axis of said rod, second means contacting said rod for reciprocating said rod in its axial direction, said second means being engaged between said rod and said sleeve to cause said rod to rotate together with said sleeve about its own axis when said sleeve is oscillated by said first means, and means for actuating said first and second means whereby the rod and needles carried by said rod are oscillated and reciprocated simultaneously.

2. A crossing warp mechanism according to claim 1 wherein said means for oscillating said sleeve and said rod comprises a grooved rim having a helical groove formed in the circumference thereof, and said sleeve comprises a tooth projecting outwardly from the circumference thereof and disposed in engagement with said helical groove.

3. A crossing warp mechanism according to claim 1, including a support frame, said means for reciprocating said rod comprises an elongated lever pivoted at one end to said frame, said lever having a longitudinal groove formed therein, and securing means at the other end for attaching said lever to said rod.

4. A crossing warp mechanism according to claim 2, wherein said means for actuating said first and second means comprises a rotatable shaft, an auxiliary shaft for a loom in which a fabric is being formed, means in operative engagement with said auxiliary shaft and said rotatable shaft for rotating said rotatable shaft, a pinion gear affixed to said rotatable shaft, said rim having teeth formed in its inner circumference thereof, said teeth on said rim in meshed engagement with said pinion gear, whereby said rim is rotated and said sleeve and said rod are oscillated.

5. A crossing warp mechanism according to claim 3, wherein said means for actuating said first and second means comprises a rotatable shaft, an auxiliary shaft for a loom in which a fabric is being formed, means in operative engagement with said auxiliary shaft and said rotational shaft for rotating said rotatable shaft, a plate mounted on one end of said rotatable shaft and having a lug eccentric to the axis of said shaft projecting therefrom, said lug slidably engaging said longitudinal groove in said lever, whereby upon rotation of said rotatable shaft, said lug effects pivoting of said lever to thereby cause said rod to reciprocate.

6. A crossing warp mechanism according to claim 1 wherein said needle-holding plate comprises a projection having a cutout formed therein for the reception of a weft gripper of a loom.

* * * * *